United States Patent [19]

Kaufman

[11] 4,209,824

[45] Jun. 24, 1980

[54] ELECTRICALLY ILLUMINATED BOOK

[76] Inventor: Beverly F. Kaufman, 801 Amolac Dr., St. Louis, Mo. 63141

[21] Appl. No.: 874,405

[22] Filed: Feb. 2, 1978

[51] Int. Cl.[2] ..... A47B 19/00

[52] U.S. Cl. ..... 362/98; 362/806

[58] Field of Search ..... 362/98, 99, 123, 241, 362/806, 810, 125, 122; 35/35 E; 40/124.1, 152.2, 540; 281/8, 15, 38

[56] References Cited

U.S. PATENT DOCUMENTS

| | | | |
|---|---|---|---|
| 2,298,754 | 10/1942 | Davis | 40/130 |
| 2,506,113 | 5/1950 | Sonells | 281/8 |
| 2,826,844 | 3/1958 | Leika | 40/152.2 |
| 3,463,918 | 8/1969 | Franc | 362/123 |
| 3,622,771 | 11/1971 | Franc | 362/99 |

*Primary Examiner*—Benjamin R. Padgett
*Assistant Examiner*—J. L. Barr
*Attorney, Agent, or Firm*—Cohn, Powell & Hind

[57] ABSTRACT

The electrically illuminated book can include a single page such as a greeting card or multiple pages such as a child's picture or story book. A pictorial illustration is provided on the page in which an illustration portion could be expected realistically to emit light, and a miniature lamp which may be a light emitting diode is disposed within this illustration portion. An electrical assembly is carried by the book, the assembly including an electric power source connected operatively to the lamp, and a digitally operated switch for selectively energizing the lamp in the illustration portion. The page has adjacent superimposed sheets, one sheet providing the front side of the page and another sheet providing the reverse side of the page. A printed circuit card or electrical conductors such as wiring is disposed between the front and reverse sheets of the page and operatively connects the power source to the lamp. The electrical power source and digitally actuated switch are mounted on a cover attached to the page. A transparent film is attached to the page and overlies the lamp for providing a protective shield. In one embodiment, the front and reverse sheets are each provided with the pictorial illustrations, and miniature lamps are disposed within the illustration portions on the front and reverse sheets of the page. The transparent film is attached to the page and overlies the lamps on the front and reverse sheets for providing the protective shield.

8 Claims, 10 Drawing Figures

ELECTRICALLY ILLUMINATED BOOK

BACKGROUND OF THE INVENTION

This invention relates generally to an electrically illuminated book, and more particularly to a book having a single page such as a greeting card or a book having multiple pages such as a children's picture and/or story book.

In a prior known illuminated book, as disclosed in U.S. Pat. No. 3,622,771, a lamp is carried by the rear cover of the book and is exposed through aligned openings provided in the superimposed pages. With this structural arrangement, a single lamp is used and is fixed in place without any flexibility in locating the lamp in different positions on different pages. There is no disclosure that such a lamp constitutes any part of a pictorial illustration provided on any of such pages.

SUMMARY OF THE INVENTION

In the present electrically illuminated book, the miniature lamps can be placed in those illustration portions that can be expected realistically to emit light in any type of pictorial illustration provided on the page without restriction to the number of lamps or the particular location of such lamps.

In addition to the uniqueness and attractiveness of the electrically illuminated book, it provides another dimension in the area of education for those with hearing-speech problems, perceptual, motor-learning disabilities, autistic problems, as well as those who are retarded or emotionally disturbed. The surprise and fascination of not only light, but multi-colored lights can be ingeniously used in the illuminated book, not only to obtain the attention of the student, but to hold it as well. One of the problems in the area of such education is to capture and hold the student's attention for any length of time.

The electrically illuminated book includes a page having a pictorial illustration in which a portion could be expected realistically to emit light, and a miniature lamp disposed within this illustration portion on the page. An electrical means is carried by the book and includes an electric power source connected operatively to the lamp, and a digitally actuated switch for selectively energizing the lamp in the illustration portion.

The page of the electrically illuminated book includes adjacent superimposed sheets, one sheet providing the front side of the page and another sheet providing the reverse side of the page. The electrical means includes a printed circuit card disposed between the front and reverse sheets of the page, the printed circuit card operatively connecting the power source to the lamp. Of course, conventional electrical wiring may be used.

The electric power source and digitally actuated switch are mounted on a cover attached to the page.

For providing a protective shield, a transparent film is attached to the page and overlies the lamp.

In one embodiment, the front and reverse sheets of the page are each provided with pictorial illustrations in which a portion could be expected realistically to emit light, and miniature lamps are disposed within the illustration portions on both the front and reverse sheets. When miniature lamps are placed on both the front and reverse sheets of the page, the transparent film is attached to the page and overlies the lamps on the front and reverse sheets for providing protective shields for all lamps.

DESCRIPTION OF THE PREFERRED EMBODIMENTS

Figure 1:
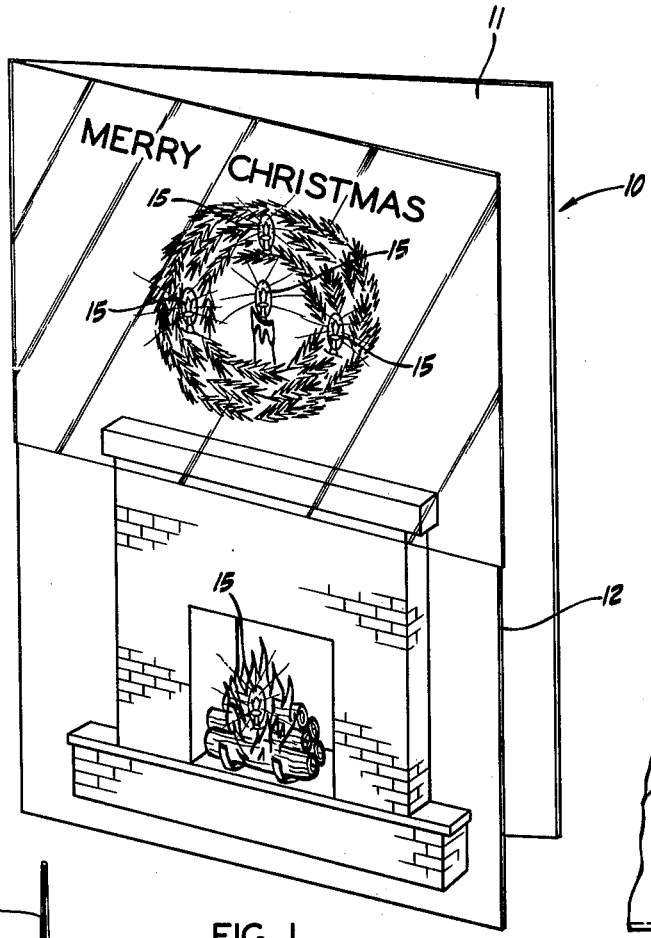
FIG. 1 is a perspective view of the electrically illuminated book such as a greeting card.

Referring now by characters of reference to the drawings, and first to the electrically illuminated book 10 illustrated in FIGS. 1–4, and representative of a greeting card, it will be understood that the book 10 includes a back cover 11 and a front page 12. The page 12 includes a front sheet 13 and a reverse sheet 14 located in adjacent superimposed relation. Provided on the page 12, and particularly on the front sheet 15, is a pictorial illustration as for example, a wreath and a fireplace in FIG. 1. The pictorial illustration has a portion such as a candle in the wreath and a log in the fireplace that could be expected realistically to emit light. A miniature lamp 15 which may be a light emitting diode is disposed within these illustration portions.

Figure 2:
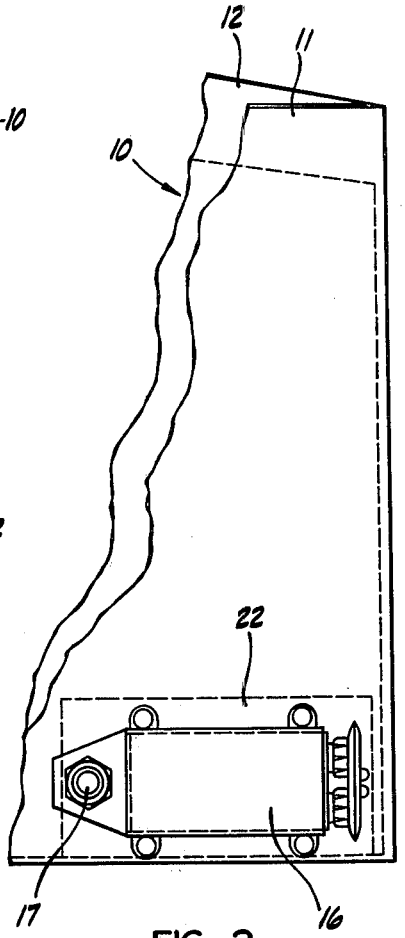
FIG. 2 is a fragmentary rear view of the book shown in FIG. 1, illustrating the mounting of the power source and switch.
Figure 3:
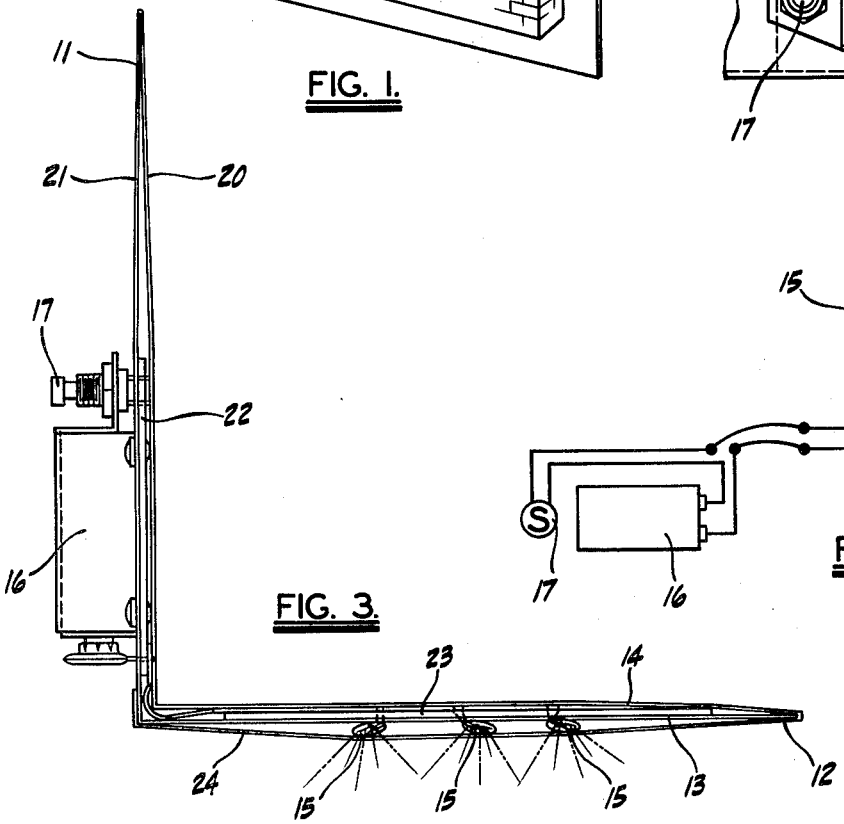
FIG. 3 is a top plan view of the book of FIG. 1.
Figure 4:
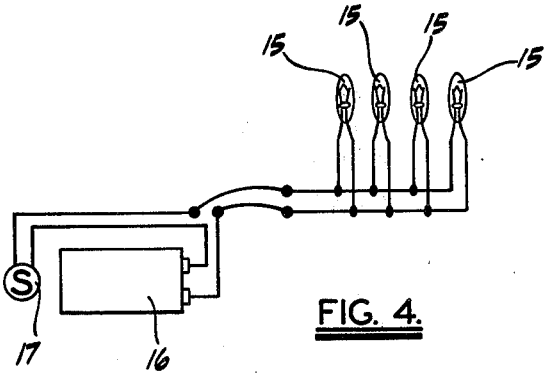
FIG. 4 is a circuit diagram of the electrical assembly utilized in the book of FIG. 1.
Figure 5:
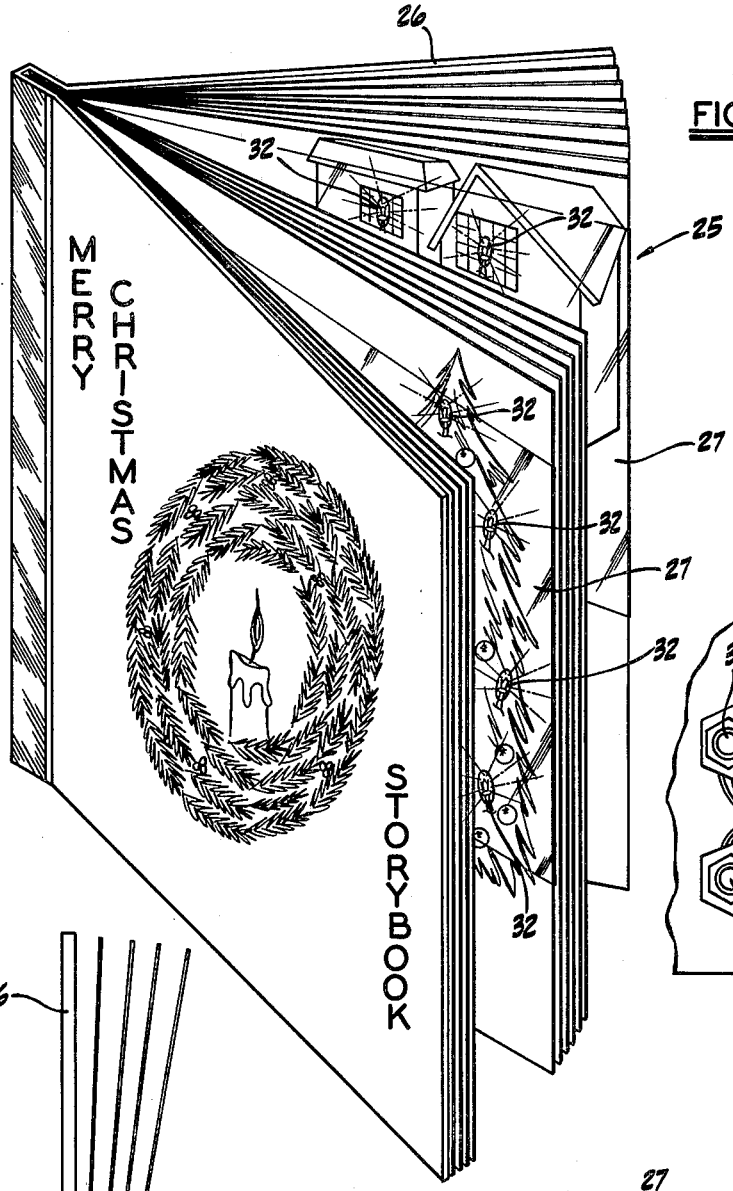
FIG. 5 is a perspective view of another illuminated book such as a children's picture and/or story book.
Figure 6:
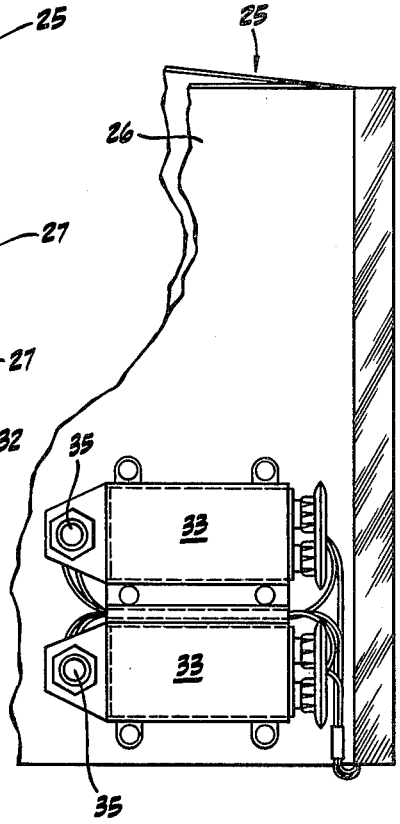
FIG. 6 is a fragmentary, rear view of the book of FIG. 5, illustrating the mounting of the power source and switch.
Figure 7:
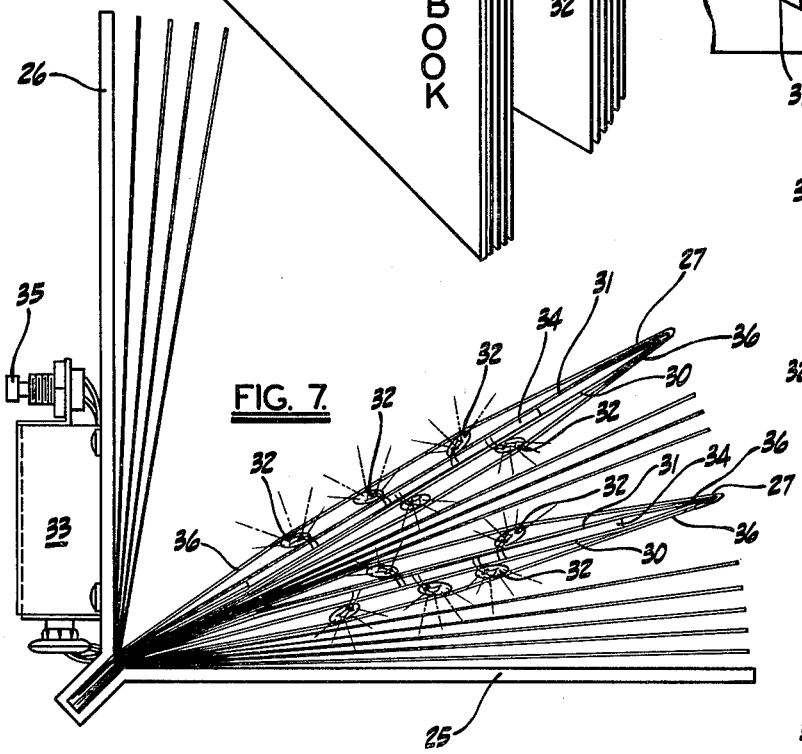
FIG. 7 is a top plan view of the book of FIG. 5.
Figure 8:
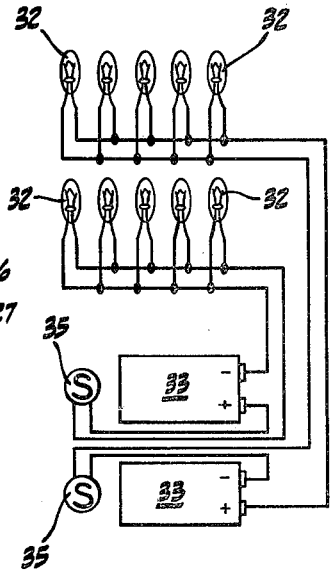
FIG. 8 is a circuit diagram of the electrical circuit utilized in the book of FIG. 5.

An electrical means is carried by the book, the electrical means including an electric power source 16 such as a DC battery and a digitally actuated switch 17. As is best shown in FIGS. 2 and 3, the rear cover 11 includes adjacent superimposed sheets 20 and 21 having a substantially rigid planar member 22 therebetween. The power source 16 and switch 17 are mounted on the back cover 11, and more particularly are mounted on the rear cover sheet 21 to the intervening substantially rigid member 22.

An electrical circuit means provided by a printed circuit card 23 is disposed between the front and reverse sheets 13–14 of the page 12, the printed circuit card operatively connecting the power source 16 to the lamps 15. Of course, conventional electrical wiring may be used.

To provide a protective shield for the lamps 15, a transparent film 24 is attached to the page 12 and overlies the lamps 15 on the front sheet 13.

To energize the lamps 15, the viewer closes the switch 17. The light from the lamps 15, which may be multicolored and which are in illustration portions expected to realistically emit light, attract and hold the attention of the user.

The illuminated book referred to by 25 is of the children's story and/or picture book type. This book 25 includes a back cover 26 and a plurality of pages 27.

Figure 9:
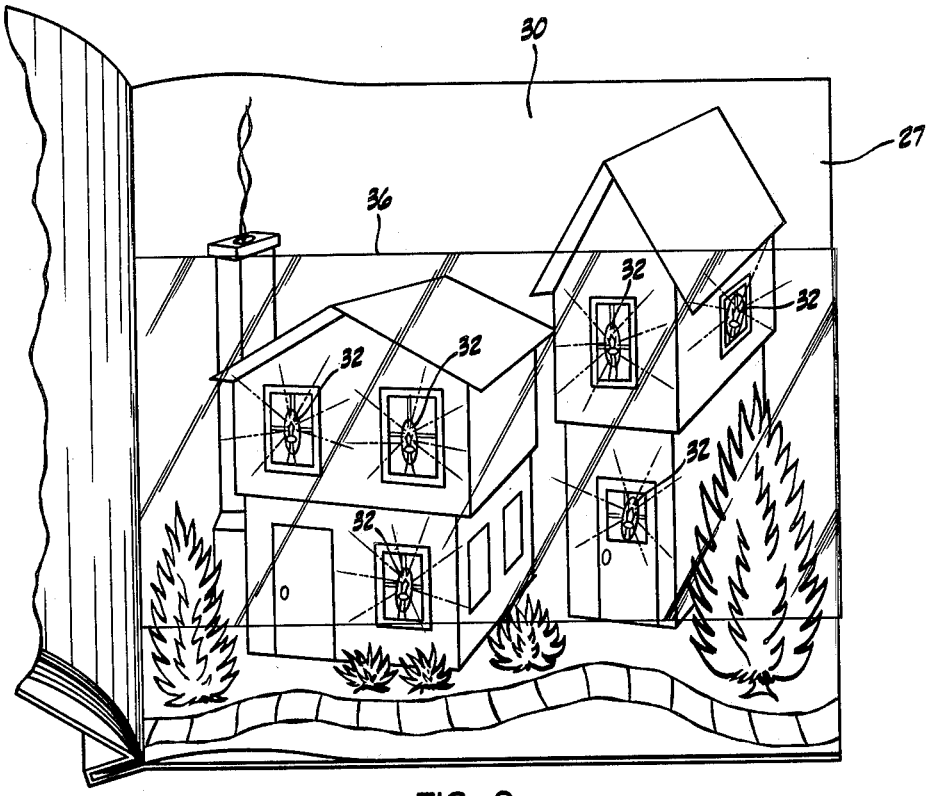
FIG. 9 is a front view of a page of the book of FIG. 5 showing one type of illustration.
Figure 10:
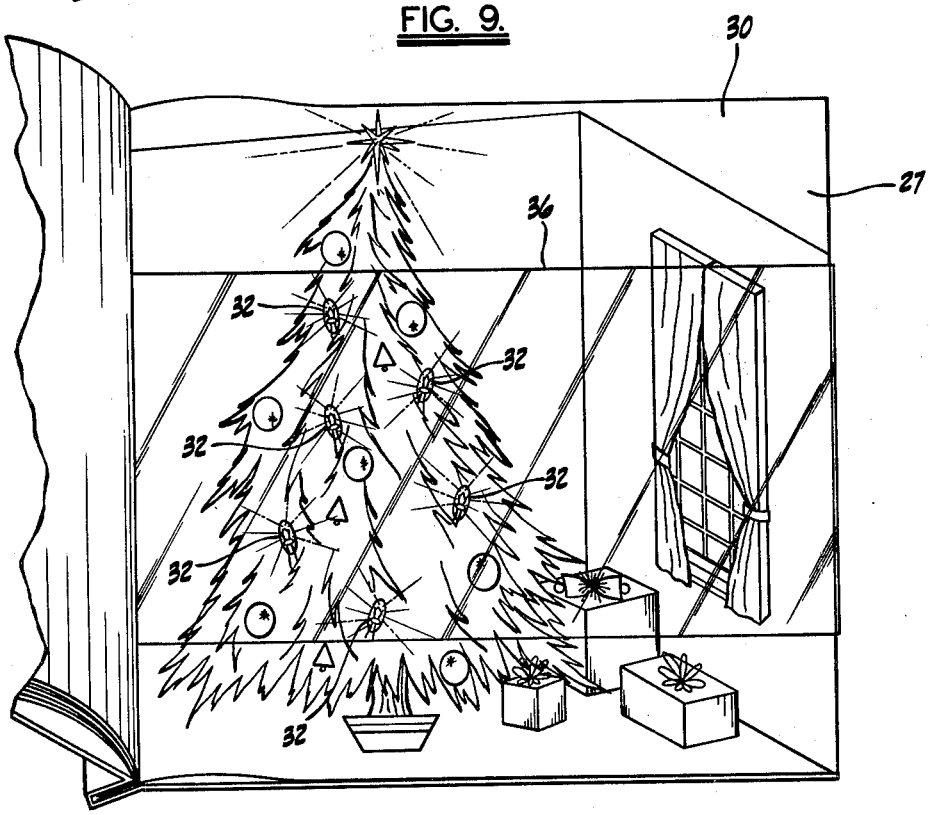
FIG. 10 is a front view of a page of the book of FIG. 5 showing another type of illustration.

Each of the pages 27 includes adjacent superimposed sheets 30 and 31, sheet 30 providing the front side of the page 27 and the other sheet 31 providing the reverse side of the page 27. Each of the front and reverse sheets 30–31 of pages 27 is provided with a pictorial illustration of the type that is perhaps best shown in FIGS. 9 and 10 in which a portion could be expected realistically to emit light, i.e., house windows in FIG. 9 and Christmas tree lights in FIG. 10. A plurality of miniature lamps 32 are disposed within these illustrated portions on the front and reverse sheets 30–31. These lamps 32 can be multicolored as desired.

An electrical means is carried by the book 25 for selectively energizing the lamps 32 to attract and retain the attention of the viewer. This electrical means includes an electrical power source 33 such as a DC battery mounted on the rear cover 26 of the book 25. An electric circuit means provided by a printed circuit card 34 is disposed between the front and reverse sheets 30–31 of each of the pages 27, the printed circuit card 34 operatively connecting the power source 33 to the lamps 32. Of course, conventional electrical wiring may be used. A digitally actuated switch 35 is mounted with the power source 33 to the rear cover 26 of book 25, for selectively energizing the lamps 32 in the illustrated portions.

A transparent film 36 is attached to each of the pages 27 and overlies the lamps 32 on the front and reverse sheets 30-31 for providing a protective shield.

Although separate power sources 33 are provided for the lamps 32 associated with each of the pages 27 in the embodiment shown, it will be understood that upon appropriate adjustments to the electrical circuit, such lamps 32 can be energized from a single power source or from any number of desired power sources, and upon appropriate location and connection of switches 35, any number of lamps 32 on the pages 27 can be selectively energized.

Again, as described previously, the user of this electrically illuminated book can selectively energize the lamps 32 on any of the pages 27 by closing the appropriate switch 35, thereby lighting the lamps 32 within the illustrated portions that could be realistically expected to emit light in the pictorial illustrations, and capturing the attention of the viewer which is usually a child.

I claim as my invention:

1. In an electrically illuminated book:

(a) a page having a pictorial illustration in which a portion of the illustration could be expected realistically to emit light, (b) a miniature electric lamp disposed within the said illustration portion on the page, and (c) an electrical means carried by the book and including:

1. an electric power source connected operatively to the lamp, and
2. a digitally actuated switch operatively connected between the power source and lamp for selectively energizing the lamp in the illustration portion.

2. In an electrically illuminated book as defined in claim 1, in which:

(d) the page includes adjacent superimposed sheets, one sheet providing the front side of the page and another sheet providing the reverse side of the page, the pictorial illustration and lighted illustration portion within which the electric lamp is disposed is provided on at least one of the sheets, and (e) the electrical means includes an electrical circuit means located between the front and reverse sheets of the page for operatively connecting the power source to the electric lamp.

3. In an electrically illuminated book as defined in claim 2, in which:

(f) the electrical means includes a printed circuit card disposed and retained between the front and reverse sheets.

4. In an electrically illuminated book as defined in claim 2, in which:

(f) a transparent film is attached to the page and overlies the electric lamp and the sheet on which the lamp is disposed for providing a protective shield for the lamp.

5. In an electrically illuminated book:

(a) a page including adjacent superimposed sheets, one sheet providing the front side of the page and another sheet providing the reverse side of the page, the front and reverse sheet each being provided with pictorial illustrations in which a portion of each illustration could be expected realistically to emit light, and the said illustration portions of the front and reverse sheets of the page being misaligned, (b) miniature electric lamps disposed within the said misaligned illustration portions of the front and reverse sheets of the page, and (c) an electrical means carried by the book and including:

1. an electric power source,
2. an electric circuit means located between the front and reverse sheets of the page for connecting the power source to the lamp, and
3. a digitally actuated switch for selectively energizing the electric lamps in the said misaligned illustration portions.

6. In an electrically illuminated book as defined in claim 5, in which:

(d) the electric circuit means includes a printed circuit card disposed and retained between the front and reverse sheets of the page.

7. In an electrically illuminated book as defined in claim 5, in which:

(d) a transparent film is attached to the page and overlies the electric lamps on both the front and reverse sheets for providing a protective shield for the lamp.

8. In an electrically illuminated book:

(a) a plurality of pages, each page including adjacent superimposed sheets, one sheet providing the front side of the page and another sheet providing the reverse side of the page, (b) miniature electric lamps disposed on the sheets of the pages in preselected, misaligned positions, and (c) an electric means carried by the book and including:

1. an electric power source,
2. an electric circuit means located between the front and reverse sheets of the pages for connecting the power source to the lamps, and
3. a digitally-actuated switch for selectively energizing the electric lamps.

* * * * *

UNITED STATES PATENT AND TRADEMARK OFFICE

CERTIFICATE OF CORRECTION

PATENT NO. : 4,209,824

DATED : June 24, 1980

INVENTOR(S) : Beverly E. Kaufman

It is certified that error appears in the above-identified patent and that said Letters Patent are hereby corrected as shown below:

In the heading of column 1 of the front page, cancel the name of the Inventor "Beverly F. Kaufman" and substitute --Beverly E. Kaufman--.

Signed and Sealed this

*Ninth* Day of *September 1980*

[SEAL]

*Attest:*

SIDNEY A. DIAMOND

*Attesting Officer*

*Commissioner of Patents and Trademarks*